US008870252B2

(12) United States Patent
Pratho

(10) Patent No.: US 8,870,252 B2
(45) Date of Patent: Oct. 28, 2014

(54) DETACHABLE HANDLE FOR A CONTAINER HAVING A BAIL

(71) Applicant: Dustin Pratho, Cypress, TX (US)

(72) Inventor: Dustin Pratho, Cypress, TX (US)

(73) Assignee: Dustin Pratho, Cypress, TX (US)

( * ) Notice: Subject to any disclaimer, the term of this patent is extended or adjusted under 35 U.S.C. 154(b) by 0 days.

(21) Appl. No.: 14/221,531

(22) Filed: Mar. 21, 2014

(65) Prior Publication Data

US 2014/0284345 A1 Sep. 25, 2014

Related U.S. Application Data

(60) Provisional application No. 61/804,450, filed on Mar. 22, 2013.

(51) Int. Cl.
*A47J 45/00* (2006.01)
*B65D 25/28* (2006.01)

(52) U.S. Cl.
CPC ..... *B65D 25/28* (2013.01)
USPC ..... 294/33; 294/27.1; 294/34; 220/758; 16/422; 16/425

(58) Field of Classification Search
USPC ..... 294/9, 10, 12, 15, 27.1, 32, 33, 34, 294/99.1; 248/210, 211, 214, 213.2; 220/756, 758, 759; 16/422, 425, 426
See application file for complete search history.

(56) References Cited

U.S. PATENT DOCUMENTS

| | | | | | |
|---|---|---|---|---|---|
| 902,236 | A | * | 10/1908 | Kintz | 294/33 |
| 2,098,996 | A | * | 11/1937 | Blake et al. | 248/210 |
| 2,541,390 | A | * | 2/1951 | Weigand | 294/27.1 |
| 2,613,860 | A | * | 10/1952 | Hoffman | 220/759 |
| 4,045,069 | A | | 8/1977 | Fife | |
| D298,200 | S | * | 10/1988 | Block et al. | 294/32 |
| 4,823,433 | A | | 4/1989 | Curtis | |
| 5,203,471 | A | | 4/1993 | Widman | |
| 5,716,034 | A | * | 2/1998 | Unkefer | 248/214 |
| 5,806,709 | A | | 9/1998 | Marshall, II | |
| 6,102,458 | A | * | 8/2000 | Scace | 294/34 |
| 6,266,849 | B1 | * | 7/2001 | Petit et al. | 294/34 |
| D456,578 | S | | 4/2002 | Smith et al. | |
| 6,394,304 | B1 | | 5/2002 | Bohne et al. | |
| 6,588,064 | B2 | * | 7/2003 | Baum | 294/33 |
| 6,863,191 | B2 | | 3/2005 | Kesling | |
| 7,255,379 | B1 | * | 8/2007 | Adams, Jr. | 294/27.1 |
| 7,387,323 | B1 | | 6/2008 | Minnette et al. | |
| 7,578,411 | B1 | | 8/2009 | Zien et al. | |
| 7,604,270 | B1 | * | 10/2009 | McCarthy | 294/29 |
| 2002/0125385 | A1 | | 9/2002 | Tweed | |

* cited by examiner

*Primary Examiner* — Paul T Chin
(74) *Attorney, Agent, or Firm* — Wong, Cabello, Lutsch, Rutherford & Brucculeri LLP.

(57) ABSTRACT

A detachable handle for holding or carrying a paint can or other similar container having a bail provides multiple hand-grip positions to allow full access to the opening of the container, while allowing for distortion of the bail. The design may accept containers of varying sizes and shapes and requires a minimum number of steps and effort to secure the device to the container. A detachable handle according to the invention may remain secured to the container when not actively in use by the user.

16 Claims, 6 Drawing Sheets

DETACHABLE HANDLE FOR A CONTAINER HAVING A BAIL

CROSS-REFERENCE TO RELATED APPLICATIONS

This application claims the benefit of U.S. Provisional Application No. 61/804,450, filed on Mar. 22, 2013.

STATEMENT REGARDING FEDERALLY SPONSORED RESEARCH OR DEVELOPMENT

Not Applicable

BACKGROUND OF THE INVENTION

1. Field of the Invention

The present invention generally concerns detachable handles for cans. More specifically, it concerns detachable handles for cans having a bail.

2. Description of the Related Art Including Information Disclosed Under 37 CFR 1.97 and 1.98

When holding or carrying a paint can, problems arise because the hand used to hold or carry the paint can may experience pain or discomfort from the bail cutting into the hand or from the hand cramping due to a prolonged, tightened grip around the thin bail. Another problem is that the position of the bail during holding or carrying the paint can causes the bail itself and the user's hand to inhibit access to the opening of the paint can. These problems result in diminished efficiency and productivity.

Others have attempted to solve one or more of these problems with devices such as those described in U.S. Publication No. 2002/0125385 by Tweed (2002), U.S. Pat. No. 7,387,323 to Minnette (2008), U.S. Pat. No. 6,863,191 to Kesling (2005), U.S. Pat. No. D456578 to Smith et al. (2002), U.S. Pat. No. 6,394,304 to Bohne et al. (2002), U.S. Pat. No. 5,806,709 to Marshall, II (1998), U.S. Pat. No. 4,823,433 to Curtis (1989), U.S. Pat. No. 4,045,069 to Fife (1977), U.S. Pat. No. 7,578,411 to Zien et al. (2009), and U.S. Pat. No. 5,203,471 to Widman (1993).

Although these prior art devices provide a solution, they are incomplete in fully addressing these problems and may create new problems. Examples of deficiencies in prior art devices include: offering only one location for the user's hand to grip the device; at least partially inhibiting access to the opening of the container; failing to allow for distortion of the bail of the container; not being designed so that one device may be used among containers of various sizes and shapes; requiring disengagement from the container when not in use (or risking accidental disengagement); and, failing to offer flexibility for additional features.

In these respects, the present invention is an improvement over the concepts and designs of the prior art in that practice of the invention provides a detachable handle that has multiple handgrip positions, allows full access to the opening of the container, compensates for distortion of the bail of the container, universally accepts containers of varying sizes and shapes, requires a minimum of steps and minimal effort to secure the device to the container, it remains secured to the container when not actively in use, and can accommodate additional value-added features for increased commercial viability. These and other advantages over the devices of the prior art will become apparent after careful consideration of the detailed description and drawings which follow.

BRIEF SUMMARY OF THE INVENTION

In one particular representative embodiment, the invention comprises a detachable handle comprising a body, a semicircular can stabilizer at the lower, inner corner of the body, and a top-mounted carrying handle. The body portion may include one or more additional handgrips.

BRIEF DESCRIPTION OF THE SEVERAL VIEWS OF THE DRAWING(S)

DETAILED DESCRIPTION OF THE INVENTION

Figure 1:
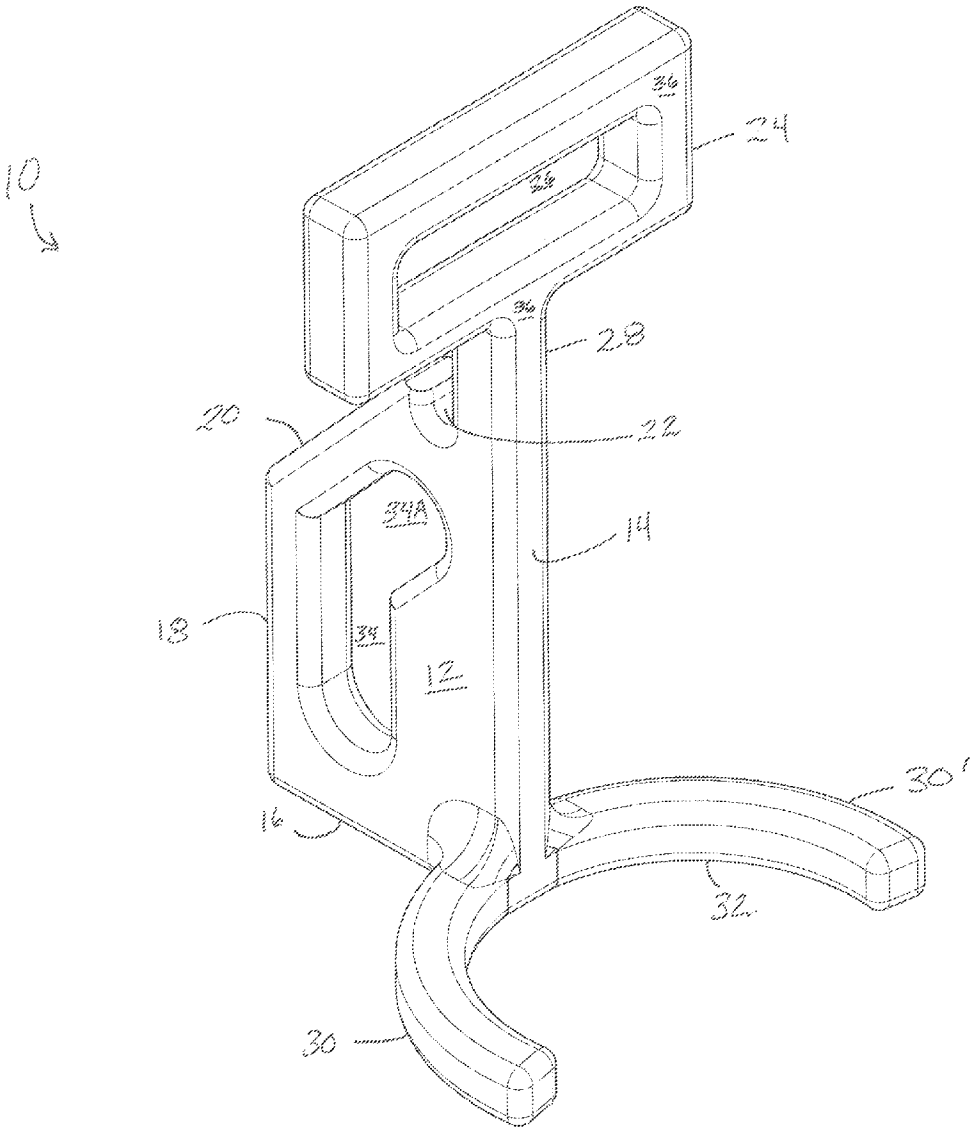
FIG. 1 is an isometric view of one, particular, illustrative embodiment of the invention.
Figure 2:
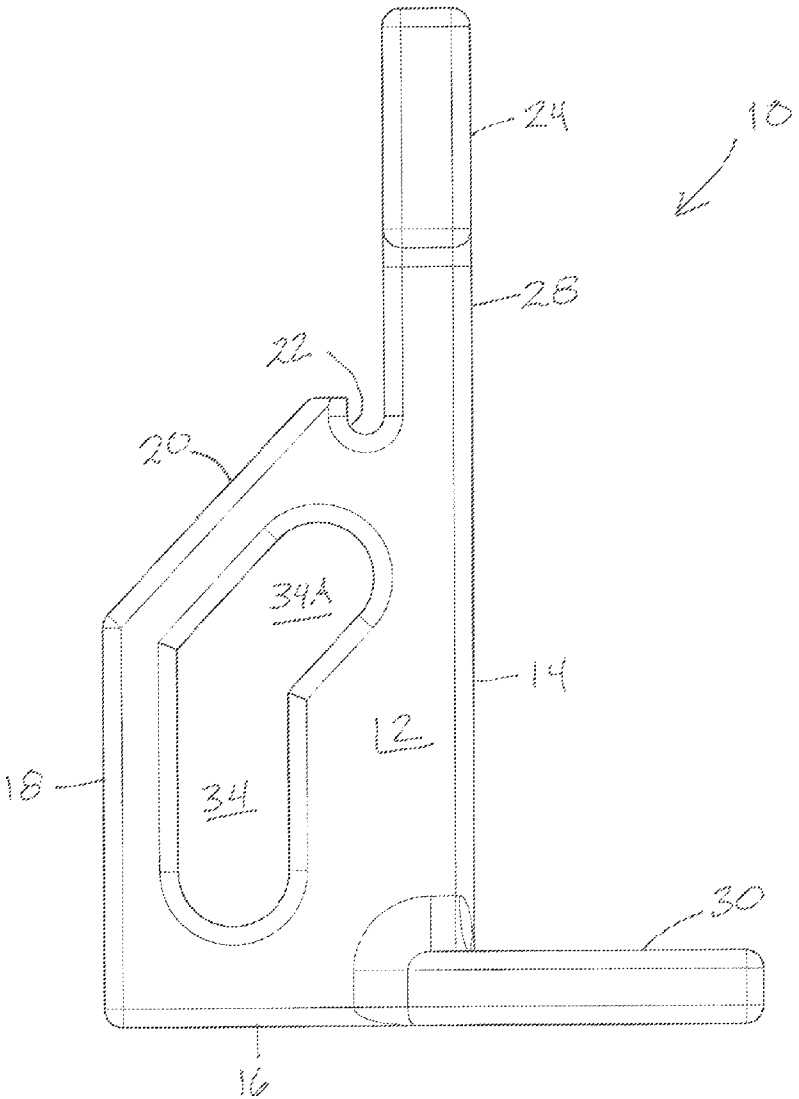
FIG. 2 is a side view of the embodiment shown in FIG. 1.
Figure 3:
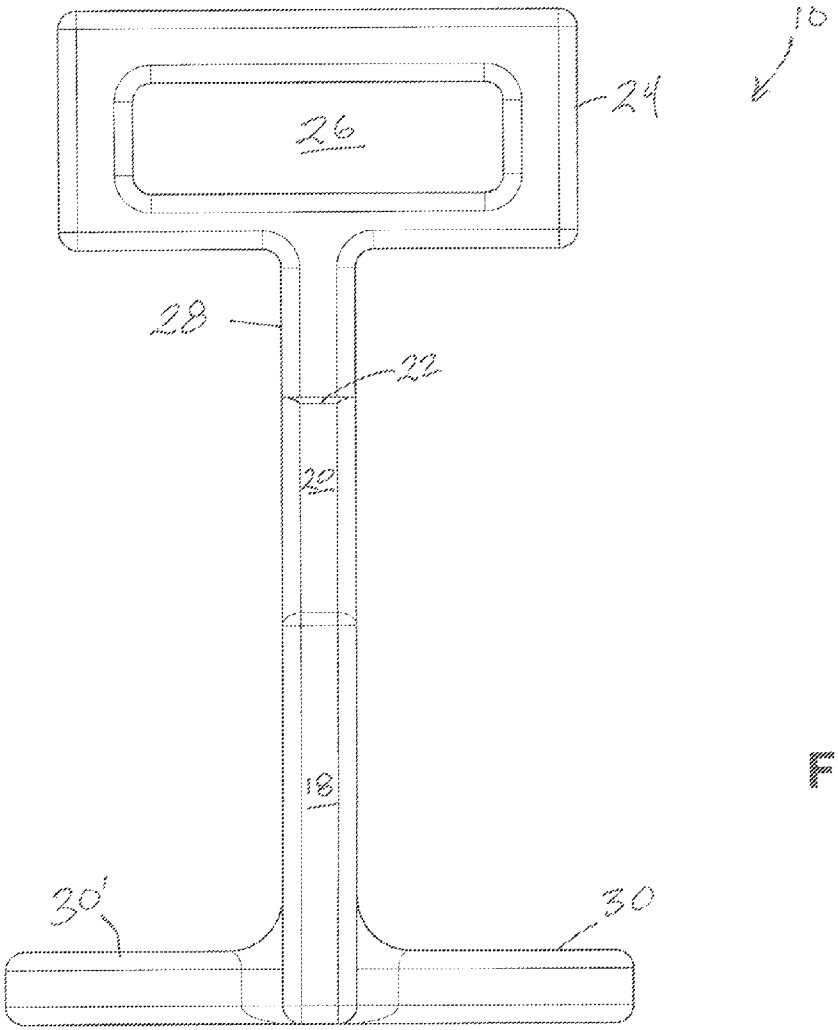
FIG. 3 is a rear view of the embodiment shown in FIG. 1.
Figure 4:
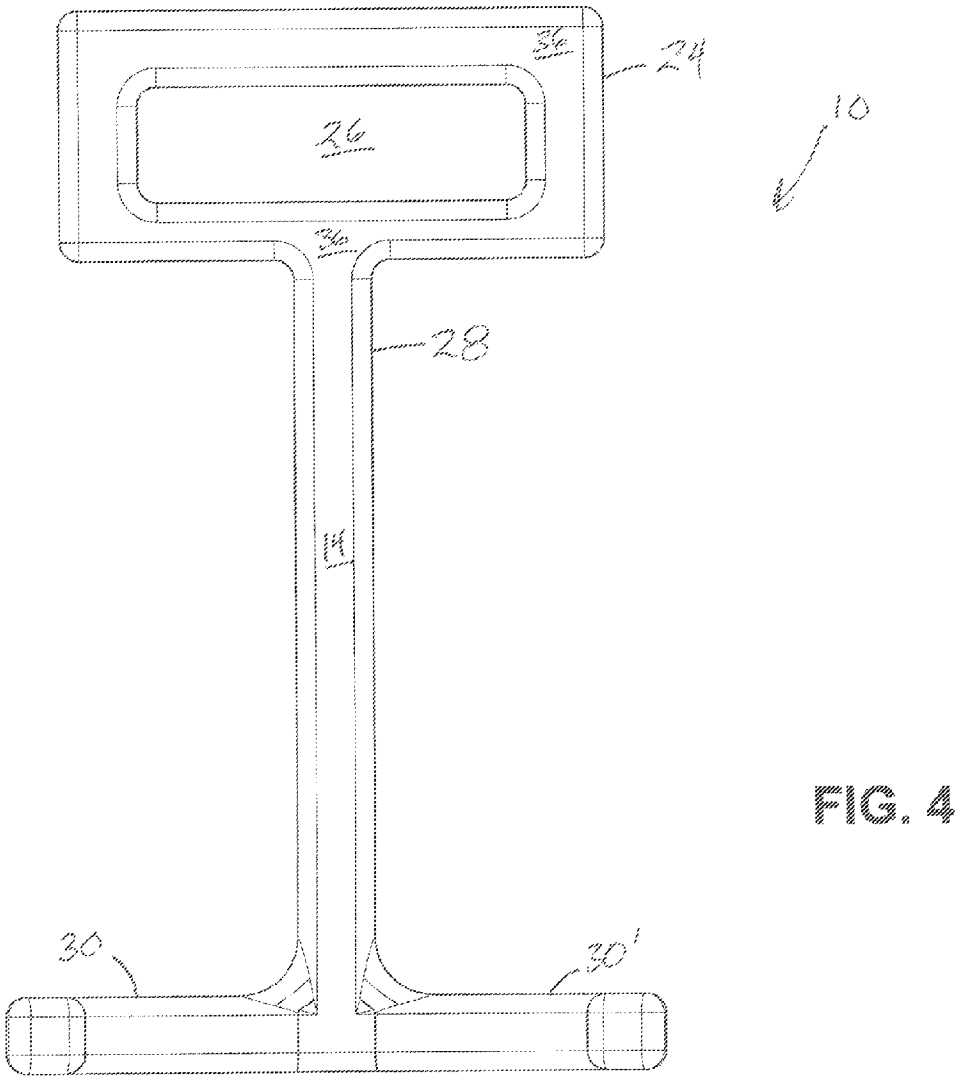
FIG. 4 is a front view of the embodiment shown in FIG. 1.
Figure 5:
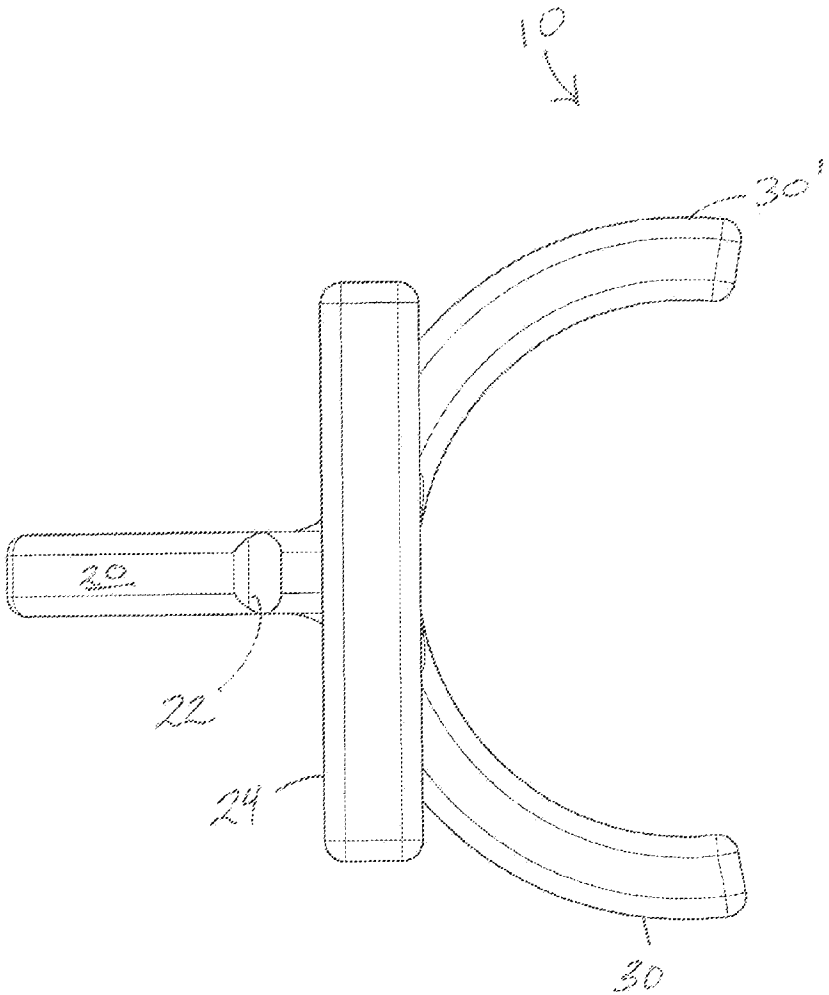
FIG. 5 is a top view of the embodiment shown in FIG. 1.
Figure 6:
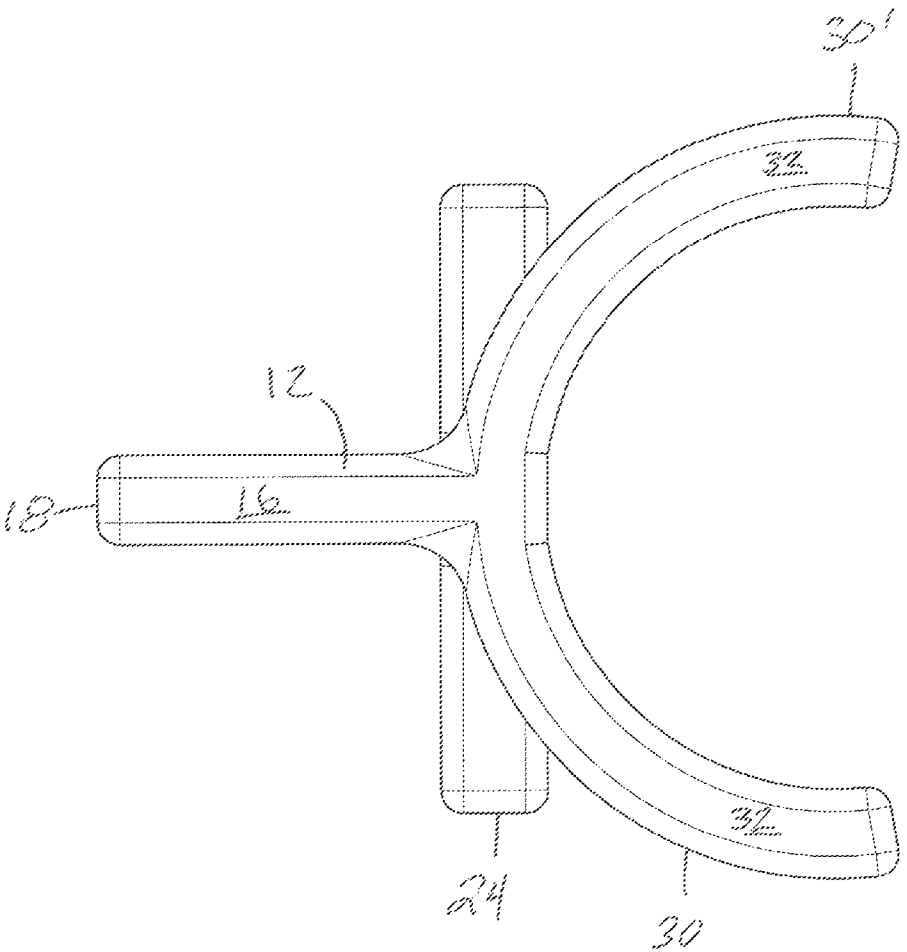
FIG. 6 is a bottom view of the embodiment shown in FIG. 1.

The invention may best be understood by reference to the illustrative embodiment shown in the drawing figures.

Detachable handle 10 is sized and configured for attachment to a generally cylindrical can equipped with a bail such as a typical, one-gallon paint can (not shown). Detachable handle 10 has a body 12 comprising a block having a generally quadrilateral cross section, an inner edge 14, a bottom edge 16 orthogonal to the inner edge, and an outer edge 18 generally orthogonal to bottom edge 16 and parallel to inner edge 14.

Generally semicircular can stabilizer 30 is attached to body 12 proximate the juncture of inner edge 14 and bottom edge 16. In an embodiment intended for use with a can of a certain outside diameter, the inside diameter of stabilizer 30 may be substantially equal to the can's outside diameter.

Vertical extension 28 extends upwardly from body 12 (as viewed in its normal, can-attached state) and may have a lower end attached to body 12 and an opposing upper end and an inner surface 36 that is generally flush and in line with inner edge 14 of body 12. Inner edge 14 is in contact with the outer surface of a can attached to detachable handle 10 when supported by handle 10.

Carrying handle 24 may be attached to the upper end of vertical extension 28.

In the illustrated embodiment of a detachable handle according to the invention, carrying handle 24 comprises a generally rectangular block having a through hole 26 sized and configured to accommodate a user's hand. The handle block may be substantially orthogonal to body 12.

Body 12 may have an upper edge 20 extending between outer edge 18 and the outer surface of vertical extension 28. Upper edge 20 of body 12 may be disposed at an obtuse angle to the outer edge 18. In the illustrated embodiment, this angle is about 136 degrees.

Notch 22 may be provided in body 12 at the juncture of upper edge 20 and the outer surface of vertical extension 28. Notch 22 may be generally U-shaped and sized to accommodate a bail. Notch 22 is optional and detachable handle 10 is fully functional with a bail resting simply at the juncture of upper edge 20 and the outer surface of vertical extension 28. Notch 22 may serve the additional purpose of guiding the user to position the bail properly. In certain embodiments, upper edge 20 may comprise a plurality of segments—e.g., an outer segment disposed at an obtuse angle to outer edge 18 and an inner segment that is substantially parallel to bottom edge 16.

Generally semicircular can stabilizer 30 may be attached at its midpoint to body 12 proximate the lower, inside corner of body 12.

Can stabilizer 30 may have a generally flat bottom surface 32 that is coplanar with bottom edge 16 of body 12. This configuration allows detachable handle 10 to stand upright on a flat surface even when it is not attached to a can.

As shown in the illustrated embodiment, can stabilizer 30 may comprise two, arc-shaped segments (30 and 30') of about 90 degrees each attached to body 12 on opposing sides thereof proximate the juncture of bottom edge 16 and inner edge 14.

It will be appreciated that detachable handle 10 in general and can stabilizer 30 in particular may be sized and configured to fit a can of certain size—for example, a standard, one-gallon paint can. In certain embodiments, can stabilizer 30 may exceed 180 degrees of arc. In such embodiments, detachable handle 10 may be used to tilt a can to which it is attached. This may be particularly useful for pouring liquids from a can. Handgrip 34 in body 12 used in conjunction with carrying handle 24 provides a convenient and expeditious means for tilting and pouring from a can to which detachable handle 10 is attached.

Detachable handle 10 may be sized to accommodate cans of various sizes. For example, when detachable handle 10 is intended for use with a one-gallon paint can, can stabilizer 30 may have an inner diameter approximately equal to the outer diameter of a typical one-gallon paint can. It will be appreciated, however, that smaller cans (i.e., cans having a smaller outer diameter) may still be accommodated by and used with a detachable handle 10 sized for a larger can.

Detachable handle 10 may further comprise a cutout in body 12 proximate outer edge 18 sized to accommodate a user's hand (thereby forming a handgrip or second handle). The cutout may have a first portion 34 that is substantially parallel to outer edge 18 and a contiguous second portion 34A disposed at an obtuse angle to the first portion. In the illustrated embodiment, second portion 34A is generally parallel to upper edge 20.

Detachable handle 10 may be fabricated of any suitable material and body 12, can stabilizer 30, vertical extension 28, and carrying handle 24 may be fabricated as a unitary whole. In one particular, preferred embodiment detachable handle 10 is formed of injection-molded plastic. Body 12, vertical extension 28 carrying handle 24 and/or can stabilizer 30 may be solid, hollow, have a honeycomb internal structure, be equipped with web-type internal stiffeners or be of any other suitable internal design.

As shown in the illustrated embodiment, bottom edge 16 of body 12 is radially disposed to a generally cylindrical can attached to detachable handle 10.

In the illustrated embodiment, the block comprising carrying handle 24 has an inner surface 36 that is generally tangential to the vertical projection of a cylindrical can attached to the detachable handle.

To use the detachable handle 10, a user may grasp body 12 with handgrip 34 (or 34A) and insert carrying handle 24 through the bail of a can until the bail is seated in notch 22. The user may then rotate detachable handle 10 until inner edge 14 contacts the upper rim of the can. Further downward rotation of body 12 will bring can stabilizer 30 into engagement with the bottom rim of the can. For embodiments wherein can stabilizer 30 exceeds 180 degrees of arc, a can may be lowered over detachable handle 10 into can stabilizer 30 with the bail of the can draped over carrying handle 24. In yet other embodiments, can stabilizer 30 may be made sufficiently deformable such that it can snap around the outside of a can when pushed from the side during the first attachment method described above.

From the description above, several advantages of a detachable handle according to the present invention are evident:

The detachable handle offers multiple handgrip positions;

The detachable handle allows full access to the opening of the can;

The detachable handle allows for distortion of the bail of the paint can;

The detachable handle may accept containers of varying size and shape, provided said containers have a bail;

The detachable handle requires a minimum number of steps and effort and no moving parts in order to secure it to the container; and, The detachable handle remains secured to the container even when not being held by the user and can stand upright independently of a container.

Accordingly, the reader will find that at least one embodiment of the detachable handle provides multiple handgrip positions to ease muscle fatigue in the user's hand and allows full access to the opening of the container. In addition, this embodiment presents a detachable handle that is easier and more convenient to use and that can be used with containers of varying size and shape and with containers with bent or distorted bails.

While the above description contains many specifics, these should not be construed as limitations on the scope, but rather as merely providing illustrations of one of the presently preferred embodiments. Many other variations are possible. For example, the handgrips can be of different sizes, shapes, and designs and can appear in varying locations and orientations on the body; the can stabilizer may be of varying configuration, lengths, widths, and thicknesses; the detachable handle can be fabricated of different materials in any number of colors or finishes; the can stabilizer and carrying handle may be attached to the body by different means; the body may be of different sizes, shapes, and thicknesses; the bail notch may be of different size, shape or location; the cutouts can be of different size, shape, angle or location; the detachable handle can be made as one piece or in multiples pieces where the carrying handle and or can stabilizer are attached separately.

Although particular embodiments of the present invention have been shown and described, they are not intended to limit what this patent covers. One skilled in the art will understand that various changes and modifications may be made without departing from the scope of the present invention as literally and equivalently covered by the following claims.

What is claimed is:

1. A detachable handle for a generally cylindrical can having a bail, comprising:

a body comprising a block having a generally quadrilateral cross section, an inner edge, a bottom edge orthogonal to the inner edge, and an outer edge generally orthogonal to the bottom edge and parallel to the inner edge;

a generally semicircular can stabilizer attached to the body proximate the juncture of the inner edge and the bottom edge;

a vertical extension on the body having a lower end attached to the body and an opposing upper end and an inner surface generally flush and in line with the inner edge of the body; and, a carrying handle attached to the upper end of the vertical extension.

2. The detachable handle as recited in claim 1 further comprising an upper edge on the body between the outer edge and the vertical extension, the upper edge being disposed at an obtuse angle to the outer edge.

3. The detachable handle as recited in claim 2 further comprising a notch in the body at the juncture of the upper edge and the vertical extension, the notch sized to accommodate a bail.

4. The detachable handle as recited in claim 3 wherein the notch is generally U-shaped.

5. The detachable handle as recited in claim 1 wherein the carrying handle comprises a generally rectangular block having a through hole sized and configured to accommodate a user's hand.

6. The detachable handle as recited in claim 5 wherein the handle block is substantially orthogonal to the body.

7. The detachable handle as recited in claim 5 wherein the block comprising the handle has an inner surface that is generally tangential to a cylindrical can attached to the detachable handle.

8. The detachable handle as recited in claim 1 wherein the can stabilizer is attached at its midpoint to the body.

9. The detachable handle as recited in claim 8 wherein the can stabilizer has a generally flat bottom surface that is coplanar with the bottom edge of the body.

10. The detachable handle as recited in claim 1 wherein the can stabilizer comprises two, arc-shaped segments of about 90 degrees each and attached to the body on opposing sides thereof proximate the juncture of the bottom edge and the inner edge.

11. The detachable handle as recited in claim 1 wherein the can stabilizer has an inner diameter approximately equal to the outer diameter of a one-gallon paint can.

12. The detachable handle as recited in claim 1 further comprising a cutout in the body proximate the outer edge sized to accommodate a user's hand.

13. The detachable handle as recited in claim 12 wherein the cutout has a first portion substantially parallel to the outer edge and a contiguous second portion at an obtuse angle to the first portion.

14. The detachable handle as recited in claim 13 wherein the second portion of the cutout is generally parallel to the upper edge of the body.

15. The detachable handle as recited in claim 1 wherein the body, can stabilizer, vertical extension, and carrying handle are unitary.

16. The detachable handle as recited in claim 1 wherein the bottom edge of the body is radially disposed to a generally cylindrical can attached to the detachable handle.

* * * * *